US008356810B2

(12) United States Patent
Aruga et al.

(10) Patent No.: US 8,356,810 B2
(45) Date of Patent: Jan. 22, 2013

(54) TRANSPORT DEVICE AND RECORDING APPARATUS

(75) Inventors: Sho Aruga, Chino (JP); Kiichiro Kanbe, Shiojiri (JP); Yosaku Tamura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/231,538

(22) Filed: Sep. 13, 2011

(65) Prior Publication Data

US 2012/0068400 A1 Mar. 22, 2012

(30) Foreign Application Priority Data

Sep. 22, 2010 (JP) ..... 2010-212445

(51) Int. Cl.
*B65H 3/52* (2006.01)

(52) U.S. Cl. ..... 271/124; 271/121; 271/19; 271/167

(58) Field of Classification Search ..... 271/121, 271/124, 19, 145, 167
See application file for complete search history.

(56) References Cited

U.S. PATENT DOCUMENTS 6,824,132 B2 * 11/2004 Asai et al. ..... 271/125
6,984,084 B2 1/2006 Ng et al.
7,455,287 B2 11/2008 Shiohara et al.
7,828,285 B2 11/2010 Chu et al.
2004/0245703 A1 12/2004 Yun et al.
2004/0251592 A1 12/2004 Ruhe et al.
2006/0236331 A1 10/2006 Ueda et al.
2011/0074090 A1 3/2011 Yanagishita
2011/0156339 A1 * 6/2011 Nakano ..... 271/4.11
2011/0292148 A1 12/2011 Shinagawa et al.
2012/0001381 A1 * 1/2012 Shinagawa et al. ..... 271/167

FOREIGN PATENT DOCUMENTS

JP 2000-335769 12/2000
JP 2005-008416 1/2005
JP 2006-124131 5/2006

OTHER PUBLICATIONS

U.S. Appl. No. 13/170,231, filed Jun. 28, 2011, Shinagawa et al.
U.S. Appl. No. 13/172,155, filed Jun. 29, 2011, Shinagawa et al.
U.S. Appl. No. 13/170,418, filed Jun. 28, 2011, Shinagawa et al.

* cited by examiner

*Primary Examiner* — Prasad Gokhale
(74) *Attorney, Agent, or Firm* — Workman Nydegger

(57) ABSTRACT

A transport device includes a stopper which comes into contact with a target ahead of a guide surface of a guide member and regulates movement of the target and a slider which slides by contact of the target with the stopper. The stopper has a first regulation surface with which the target comes into contact ahead of the guide surface of the guide member, and a second regulation surface which regulates the movement of the target which moves along the first regulation surface. A damper mechanism is connected to the slider and has a damper force that weakens kinetic energy by the target that the stopper receives.

5 Claims, 10 Drawing Sheets

TRANSPORT DEVICE AND RECORDING APPARATUS

BACKGROUND

1. Technical Field

The present invention relates to a transport device provided with a damper device, and a recording apparatus provided with the transport device.

2. Related Art

As one type of a recording apparatus which performs recording by attaching liquid (for example, ink) to a target (for example, paper), an ink jet type printer (hereinafter simply referred to as a "printer") provided with a recording section which records a given image (including characters, graphics, or the like) by ejecting ink from a liquid ejection section (for example, a recording head) onto paper is known. The printer is made so as to record an image on the paper by feeding one by one the papers to the recording section side by extracting the topmost paper from a paper feed cassette (hereinafter simply referred to as a "cassette") in which a plurality of papers are placed in a stacked state. For this reason, the printer is provided with a mounting section for mounting the cassette, in which a plurality of papers are placed in a stacked state, so as to be able to mount or remove the cassette by inserting or extracting the cassette along a direction perpendicular to the stacked direction of the paper, and a paper feed roller for extracting one by one the papers from the cassette which is in a state where it is mounted on the mounting section, thereby sequentially feeding the papers to the recording section side.

Further, in the printer, a guide surface having a rising slope for guiding the paper to the recording section while separating one by one the papers which are extracted and fed from the cassette side by the paper feed roller is formed at the deep inside of the mounting section on which the cassette is mounted, that is, at a site which faces the front end surface in an insertion direction of the cassette which is in a state where it is mounted on the mounting section. For this reason, in a case where the cassette is mounted on the mounting section by a user, when an insertion speed into the mounting section is fast or the like, there is a case where the papers in the stacked state move in the insertion direction from the inside of the cassette due to an inertial force thereof, thereby being laid on the guide surface having the rising slope. If so, since it is not possible to separate one by one the papers by the guide surface, so that a transport state called an overlap feed in which a plurality of papers are overlapped and fed occurs, there is concern that a phenomenon such as a paper jam may occur.

As means for avoiding the overlap feed, in JP-A-2005-8416, there is disclosed a mechanism which regulates the movement of an end portion (hereinafter referred to as a "paper leading end portion") on the downstream side in a paper feed direction of the paper in the insertion direction of the cassette. That is, there is disclosed a paper feed structure provided with a mechanism (a loading stopper) which is movable between a position where it protrudes into and blocks a paper movement pathway (a medium pathway) and a position where it does not protrude into and block the movement pathway.

Incidentally, as a structure which avoids the overlap feed, there is proposed, for example, a structure which has a regulation surface which regulates the movement of the paper leading end portion to the front side in the insertion direction of the cassette and also is provided with a movement regulation body which performs rotational motion so as to fall in the insertion direction. That is, there is proposed a damper device which rotates the movement regulation body in the insertion direction with a predetermined temporal difference such that after the momentum (speed) of the moving paper is restrained by regulating the movement of the paper leading end portion at the time of insertion of the cassette at the regulation surface, the regulation surface retreats from the guide surface to automatically release the regulation of the movement of the paper. Since such a damper device requires only an increase in space for a mechanism necessary for the rotational motion of the movement regulation body, a reduction in the size of the printer becomes possible.

However, if the movement regulation body which performs rotational motion so as to fall in the insertion direction has the same configuration as the movement regulation body (the loading stopper) in the paper feed structure disclosed in JP-A-2005-8416, when an insertion speed into the mounting section is fast or the like, there is a case where the paper leading end portion further moves upward along the surface of the movement regulation body, thereby being laid on the guide surface (separation pad). If so, it is not possible to separate one by one the papers by the guide surface, so that there is concern that it may not become possible to avoid the transport state called the overlap feed in which a plurality of papers are overlapped and fed.

SUMMARY

An advantage of some aspects of the invention is that it provides a transport device provided with a damper device which can regulate movement of a target with a high probability, and a recording apparatus.

According to an aspect of the invention, there is provided a transport device including: a guide member having an inclined guide surface which guides a target; a stopper which comes into contact with the target ahead of the guide surface of the guide member and regulates movement of the target; a slider which slides by contact of the target with the stopper; a first regulation surface which is provided at the stopper and with which the target comes into contact ahead of the guide surface of the guide member; a second regulation surface which is provided at the stopper and regulates the movement of the target which moves along the first regulation surface; and a damper mechanism which is connected to the slider, has a damper force that weakens kinetic energy by the target that the stopper received, and makes the first regulation surface and the second regulation surface of the stopper retreat further than the guide surface of the guide member, thereby releasing regulation of the target by the first regulation surface and the second regulation surface and allowing the target to come into contact with the guide surface of the guide member.

A damper device which is used in the transport device according to the above aspect of the invention is a damper device that moves a movement regulation body provided with a regulation surface which can regulate movement of the target by coming into contact with the target that moves in a first direction and then moves along a guide surface provided to extend in a second direction intersection the first direction, with a predetermined temporal difference from a regulation position where the regulation surface is located further at the opposite side in the first direction than the guide surface, thereby regulating the movement of the target, to a release position where the regulation surface is located further at the first direction side than the guide surface, thereby releasing the regulation of movement on the target, wherein the movement regulation body is provided with a first regulation surface which regulates the movement in the first direction of the target and a second regulation surface which regulates the movement in the second direction of the target, and after the first regulation surface is moved from the regulation position to the release position, the second regulation surface is moved from the regulation position to the release position.

According to this configuration, the target which moves in the first direction is regulated by the first regulation surface. Then, the target which moves along the guide surface provided to extend in the second direction intersecting the first direction without regulation of movement at the point of time when the first regulation surface has been moved to the release position is regulated by the second regulation surface which is at the regulation position, whereby it is possible to stop the target with a high probability. Thereafter, since the second regulation surface continues to move up to the release position, the target in which movement is stopped can be moved to the recording section side along the guide surface, for example, by a transport section.

In the damper device according to the aspect of the invention, the first regulation surface and the second regulation surface may be formed at the same member.

According to this configuration, since the first regulation surface and the second regulation surface move completely in synchronization with each other, when the first regulation surface has moved from the regulation position up to the release position, it is possible to move the movement regulation body such that the second regulation surface is reliably located at the regulation position. As a result, since it is possible to stably stop the target which moves in the second direction, it is possible to suppress running-on of the target onto the guide surface. Further, it is possible to move the first regulation surface and the second regulation surface by a single movement section.

In the damper device according to the aspect of the invention, the second regulation surface may be a surface which makes a non-obtuse angle with the guide surface when the first regulation surface has moved to the release position.

According to this configuration, since a state where the target which moves along the guide surface comes into contact with the second regulation surface without moving away from the guide surface can be maintained by the second regulation surface, it is possible to reliably stop the movement of the target. As a result, it is possible to suppress running-on of the target onto the guide surface.

In the damper device according to the aspect of the invention, the first regulation surface and the second regulation surface may be moved from the regulation position to the release position in a state where the first regulation surface and the second regulation surface make a non-obtuse angle at all times.

According to this configuration, the target which moves along the first regulation surface before it comes into contact with the guide surface can be reliably stopped by the second regulation surface. Therefore, it is possible to suppress running-on of the target onto the guide surface.

According to another aspect of the invention, there is provided a recording apparatus including: the transport device having the above configuration; and a recording section which performs recording on a target which is transported by the transport device.

According to this configuration, it is possible to realize a recording apparatus which exhibits the same effects as those of the damper device having the above configuration.

BRIEF DESCRIPTION OF THE DRAWINGS

The invention will be described with reference to the accompanying drawings, wherein like numbers reference like elements.

FIGS. 6A and 6B are schematic diagrams showing the movement state of paper in a damper device of a comparative example, wherein FIG. 6A is a diagram of a state where the stopper is at the regulation position immediately after cassette insertion, and FIG. 6B is a diagram of a state where the stopper has moved to the retreat position.

FIGS. 7A to 7D are schematic diagrams showing the movement state of paper in the damper device of the embodiment, wherein FIG. 7A is a diagram showing a state where the stopper is at the regulation position immediately after cassette mounting, FIG. 7B is a diagram showing a state where the stopper is moving to the guide surface side, FIG. 7C is a diagram showing a state where a first regulation surface of the stopper is a release position where it has moved up to the position of a guide surface, and FIG. 7D is a diagram showing a state where a second regulation surface of the stopper restrains movement of the paper along the guide surface.

FIGS. 8A to 8C are schematic diagrams showing the movement state of the paper in the damper device of the embodiment with respect to a case where the number of stacked papers is small, wherein FIG. 8A is a diagram showing a state where the stopper is at the regulation position immediately after cassette mounting, FIG. 8B is a diagram showing a state where the papers have come into contact with the first regulation surface, and FIG. 8C is a diagram showing a state where the papers move along the first regulation surface.

FIGS. 9A to 9C are schematic diagrams showing the movement state of the paper in a damper device of a modified example, wherein FIG. 9A is a diagram showing a state where a first stopper is at the regulation position immediately after cassette mounting, FIG. 9B is a diagram showing a state where the first stopper has moved up to the position of a guide surface, and FIG. 9C is a diagram showing a state where the first stopper moves to the retreat position and a second stopper is located at the release position where it has retreated from the guide surface.

DESCRIPTION OF EXEMPLARY EMBODIMENTS

Hereinafter, an embodiment of a damper device according to the invention will be described using the drawings as an embodiment in which the damper device is embodied in a printer as a recording apparatus having a transport device provided with the damper device.

Figure 1:
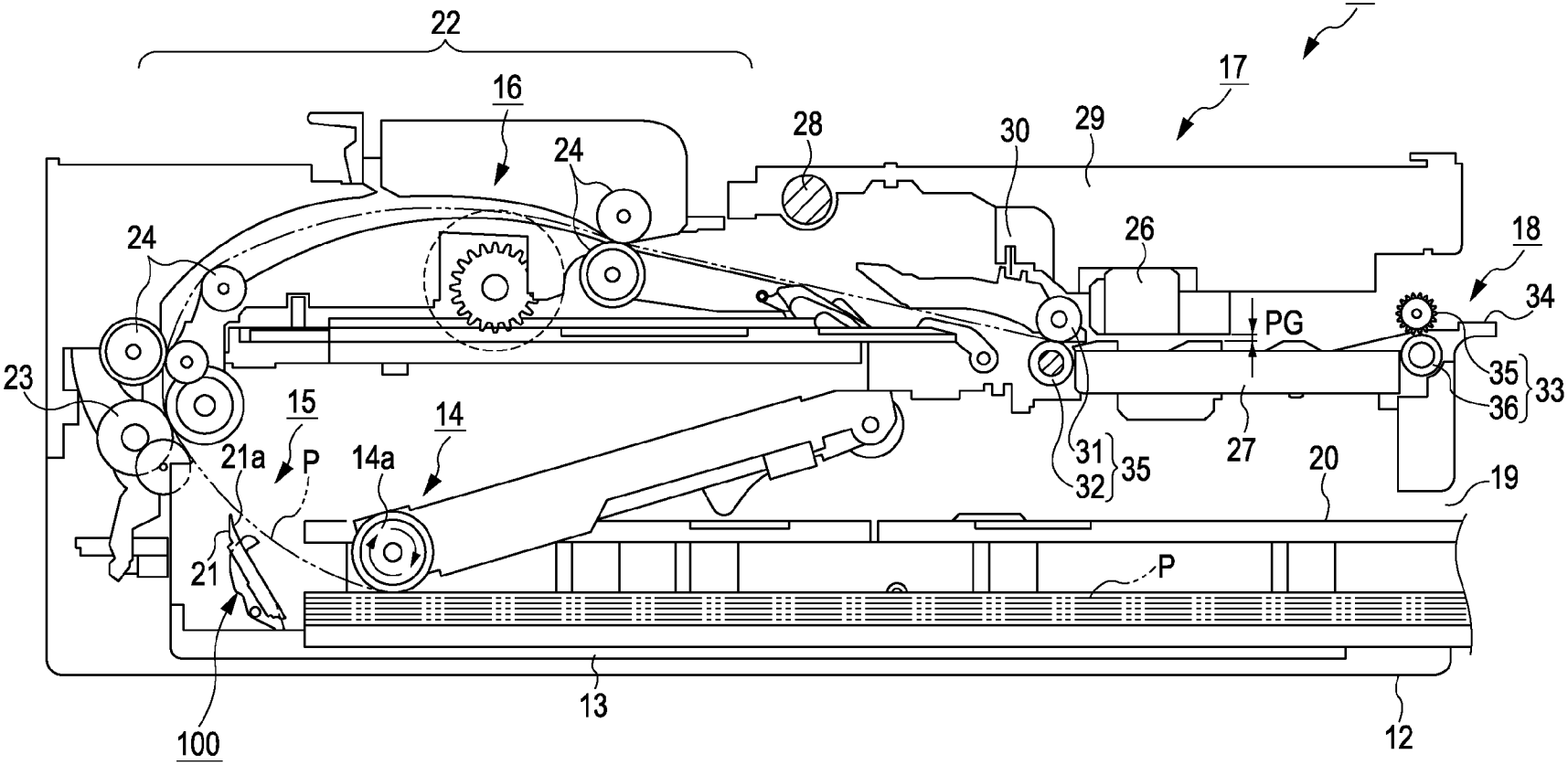
FIG. 1 is a schematic diagram showing a schematic configuration of a printer of an embodiment.

As shown in FIG. 1, a printer 11 of this embodiment includes a mounting section 13, a feed section 14, a separation section 15, a transport section 16 as a transport unit, a recording section 17 as a recording unit, and a discharge section 18 within a frame 12 forming a casing. In addition, these sections are disposed in sequence along a transport pathway of paper P as a target on which recording is carried out in the printer 11.

First, the mounting section 13 is disposed at the bottom portion side (in FIG. 1, the lower portion side) in the frame 12 and communicates with the outside of the frame 12 through a rectangular insertion opening 19 opened at one side surface (in FIG. 1, a right side surface) of the frame 12. Then, by inserting or extracting a cassette 20, in which the papers P are placed in a stacked state, in a first direction (in FIG. 1, the right-and-left direction) perpendicular to the stacked direction of the paper P through the insertion opening 19, the papers P along with the cassette 20 can be detachably mounted on the mounting section 13.

Next, the feed section 14 is disposed at a position corresponding to the deep inside of the mounting section 13 in the frame 12 and provided with a pickup roller 14*a* which rotates on the basis of the driving force of a feed motor (not shown). Then, a feed operation is performed in which the topmost paper P among the papers P which are placed in a stacked state in the cassette 20 inserted from the insertion opening 19 into the mounting section 13 is fed in a direction opposite to the insertion opening 19 by rotation of the pickup roller 14*a*.

Further, the separation section 15 is provided with a guide plate 21 disposed at a position which faces the front end surface in an insertion direction of the cassette 20 which is in a state where it is mounted on the mounting section 13, in the frame 12. At the guide plate 21, a guide surface 21*a* having an inclined plane of rising slope extending in a second direction intersecting the first direction when viewing from the mounting section 13 side is formed. Then, the paper P fed from the feed section 14 to the guide surface 21*a* of the guide plate 21 moves while bringing a paper leading end into contact with the guide surface 21*a*, whereby the separation section 15 sends one by one the papers P to the transport section 16 on the downstream side. Therefore, the guide surface 21*a* becomes a separation slope which separates and sends the papers P one by one.

As shown in FIG. 1, the transport section 16 is disposed in the frame 12 so as to form an inversion transport path 22 which can invert the paper P sent from the separation section 15 and then transport the paper P to the recording section 17 side of an upper portion in the frame 12. Then, at the upstream side of the inversion transport path 22, a separation roller 23 is provided, and further at the downstream side of the inversion transport path 22 than the separation roller 23, a plurality of intermediate transport rollers 24 are provided being spaced apart in a transport direction.

The separation roller 23 is made so as to separate the papers P overlapped and sent without being separated at the guide surface 21*a* and then reliably send one by one the papers P to the downstream side where the intermediate transport rollers 24 are provided. The intermediate transport rollers 24 are made such that they respectively perform rotational motion, thereby inverting and transporting the paper P in an inversion transport direction (in FIG. 1, the rightward direction) which becomes the opposite direction to the feed direction (in FIG. 1, the leftward direction) from the cassette 20 to the separation section 15 and then sending the paper P to the recording section 17.

Further, the recording section 17 is disposed at the upper portion in the frame 12, as already described, and includes a roller pair for transport 25, a recording head 26, and a support member 27 which becomes a support base for the paper P. The recording head 26 is fixed to a carriage 29 which can reciprocate in the width direction (in FIG. 1, a direction perpendicular to the plane of paper) intersection the transport direction of the paper P along a guide shaft 28. The carriage 29 is driven so as to move in a main scanning direction along the guide shaft 28 by a driving section (a motor) (not shown) and also made such that a position thereof in the main scanning direction is detected by a position detection device (an encoder) 30, whereby a driving position thereof is controlled.

The paper P sent to the recording section 17 having such a configuration is transported in a sub-scanning direction intersecting the main scanning direction in accordance with the rotation of a driving roller for transport 32, which constitutes the roller pair for transport 25 along with a driven roller for transport 31, while being nipped between both the rollers for transport 31 and 32, and moves between the recording head 26 and the support member 27. At this time, the paper P moves being pressed against the support member 27 and also a gap PG is formed between the paper P and the recording head 26. Then, in this state, the recording head 26 moves in the main scanning direction which becomes the width direction of the paper P along with movement of the carriage 29 and at the time of this movement, by ejecting ink as liquid for recording from nozzles (not shown) onto the paper P which is separated from the recording head 26 with the gap PG interposed therebetween, an image is formed. Thereafter, the paper P with the image formed thereon is sent to the discharge section 18.

The discharge section 18 includes a roller pair for discharge 33 and a stacker for discharge 34. The paper P is transported to the downstream side (in FIG. 1, in the rightward direction) in the transport direction in accordance with the rotation of a driving roller for discharge 36, which constitutes the roller pair for discharge 33 along with a driven roller for discharge 35 made of a gear wheel, while being nipped between both the rollers for discharge 35 and 36, thereby being discharged to stacker for discharge 34. In this way, a given image is recorded on the paper P in the printer 11.

Further, as shown in FIG. 1, the printer 11 of this embodiment is provided with a damper device 100 at a portion delivering the paper P which is sent from the cassette 20 to the separation section 15 side by the rotation of the pickup roller 14*a* and then sent to the transport section 16 while being separated one by one by the guide surface 21*a*. A transport device which stably supplies one by one the papers P to the recording section 17 is constituted by the damper device 100 and the transport section 16. Hereinafter, the damper device 100 of this embodiment will be described with reference to the drawings.

Figure 2:
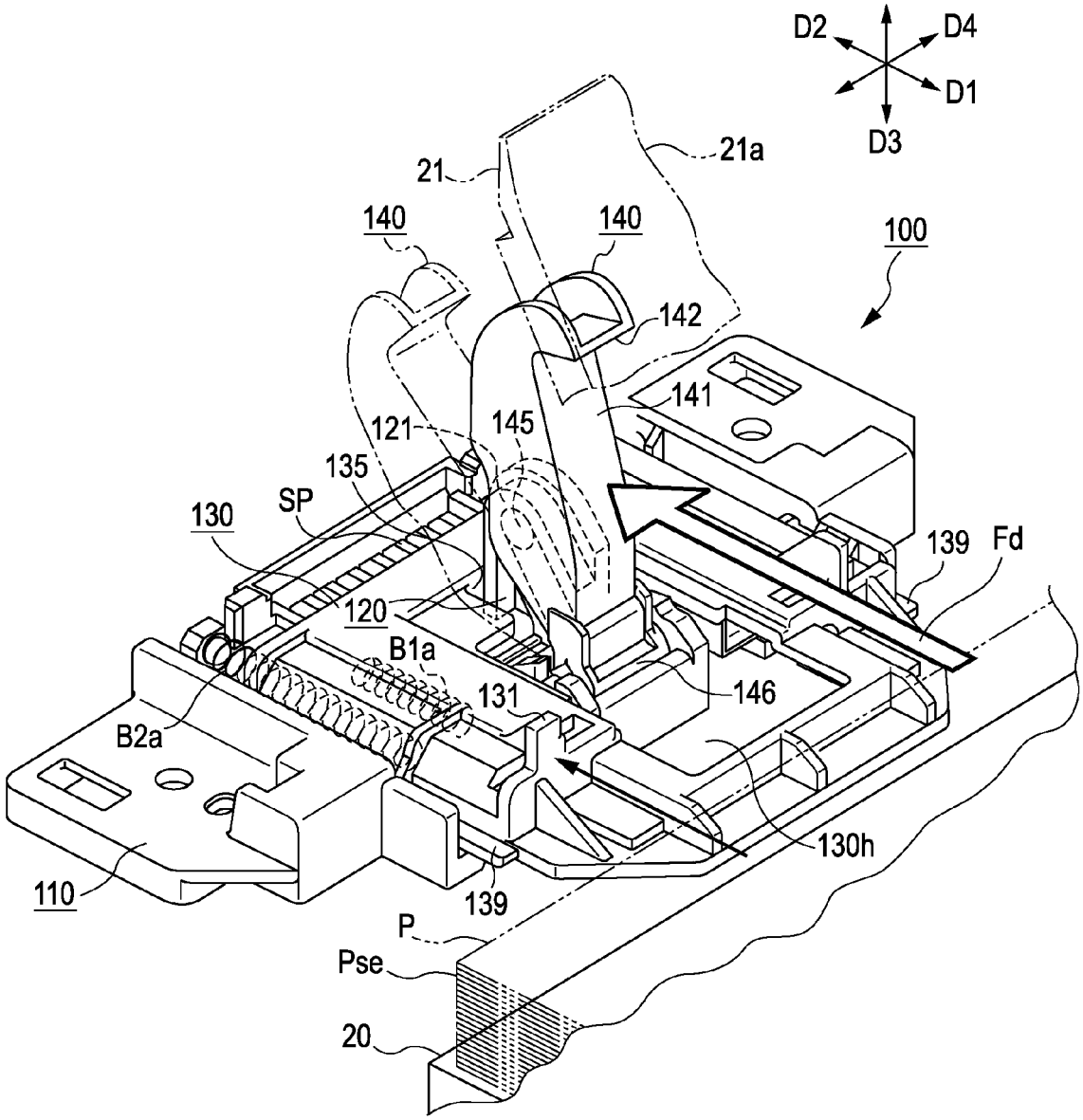
FIG. 2 is a perspective view showing the configuration of a damper device of the embodiment.

FIG. 2 is a perspective view showing the structure of the damper device 100 of this embodiment and shows a state where the cassette 20 is not mounted on the mounting section 13. As shown in the drawing, the damper device 100 includes a base 110, a slider 120, a slider cassette 130, and a stopper 140 as a movement regulation body which regulates movement of the paper P. In addition, in order to facilitate explanation in the drawings which are used in the following explanation, including FIG. 2, an extraction direction of the cassette 20 is denoted by D1, the insertion direction of the cassette 20 is denoted by D2, the thickness direction (that is, the vertical direction) of the paper P among directions perpendicular to these directions is denoted by D3, and the width direction of the paper P is denoted D4.

Figure 3:
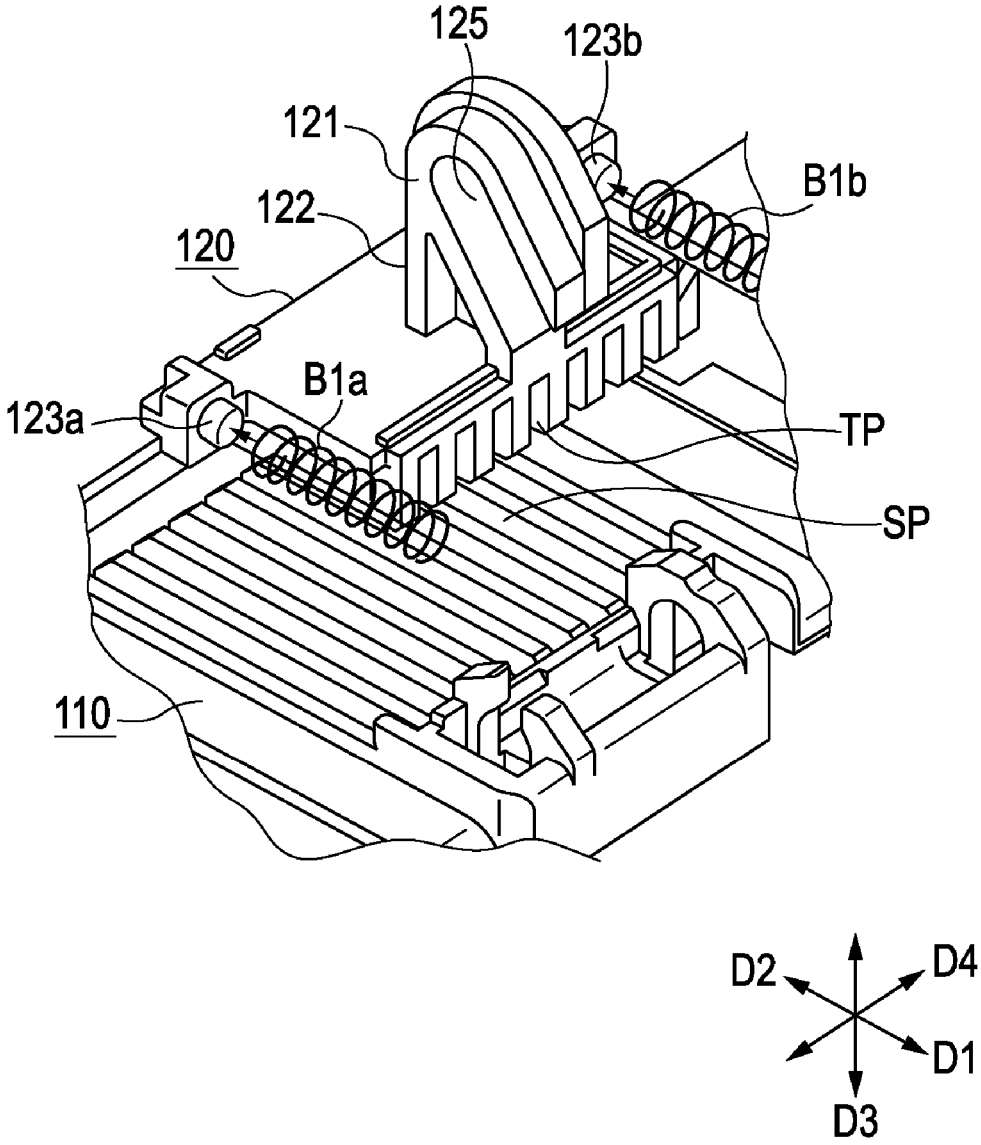
FIG. 3 is an exploded perspective view describing a damper mechanism of the damper device of the embodiment.

The base 110 is fixed to the frame 12 of the printer 11. Further, at the central portion of the base 110 in the width direction D4 of the paper P, a first sliding surface SP on which the slider 120 slides is provided. In addition, in this embodiment, a sliding direction of the slider 120 is set to be a direction following the insertion direction D2 and the extraction direction D1 of the cassette 20. The first sliding surface SP and the slider 120 will be described in first using FIG. 3. FIG. 3 is a perspective view showing a state where the slider cassette 130 and the stopper 140 are removed and also the slider 120 is separated from the base 110.

As shown in the drawing, the slider 120 is provided with a second sliding surface TP at the face side which faces the first sliding surface SP of the base 110. The second sliding surface TP has a surface shape in which recesses and projections are formed such that a shape in a cross section intersecting the sliding direction (the insertion direction D2 or the extraction direction D1) has a concavo-convex shape (a so-called comb-teeth shape) in which a concavity and a convexity are repeatedly formed in the width direction D4 intersecting the sliding direction. Then, the second sliding surface TP is formed as a surface shape in which the longitudinal directions of a plurality of projections forming a concavo-convex shape are formed to be parallel to each other along the insertion direction D2, whereby a plane area of an approximately rectangular shape is exhibited in a plan view in the thickness direction D3 which becomes an overlap direction with the first sliding surface SP.

On the other hand, the base 110 is provided with the first sliding surface SP which has a longer plane area in the insertion direction D2 than the second sliding surface TP of the slider 120 such that the slider 120 can move by a predetermined distance in the extraction direction D1 and the insertion direction D2 of the cassette 20. At the first sliding surface SP, a concavo-convex shape is formed which faces the concavo-convex shape formed at the second sliding surface TP while being spaced apart by a predetermined distance with viscous grease as a viscous member interposed therebetween.

The slider 120 is made so as to be able to move on the first sliding surface SP of the base 110 with the viscous grease interposed between the second sliding surface TP and the first sliding surface SP while being biased in the insertion direction D2 by a pair of coil springs B1*a* and B1*b* as biasing sections. At this time, a damper mechanism which generates buffer power (also referred to as a damper force) in the sliding direction is constituted between the first sliding surface SP and the second sliding surface TP which faces the first sliding surface SP with the viscous grease interposed therebetween.

Further, on the surface of the slider 120 on the opposite side to the surface where the second sliding surface TP is provided, a projecting portion 121 exhibiting a shape of a so-called hook type is formed. In the projecting portion 121, a slit-like engagement space 125 having a given width and penetrating in the width direction D4 and also having an opening end at the extraction direction D1 side is provided into an oblique shape so as to have a descent slope toward the extraction direction D1. An engagement pin 145 of the stopper 140, which will be described later, is engaged with the engagement space 125, as shown in FIG. 2.

Returning to FIG. 2, the slider cassette 130 is made such that end portions 139 on both sides in the width direction D4 are engaged with the base 110 and the slider cassette 130 can reciprocate (slide) along the insertion direction D2 and the extraction direction D1 while maintaining the engagement state. Further, the slider cassette 130 is made so as to be biased in the extraction direction D1 by a pair of coil springs B2*a* and B2*b* (refer to FIGS. 4A and 4B).

The coil springs B2*a* and B2*b* are compression springs disposed such that one end of each spring is supported on or fixed to the base 110 and the other end is supported on or fixed to the slider cassette 130. Further, these coil springs B2*a* and B2*b* are respectively disposed at positions more distant from the center of the second sliding surface TP in the width direction D4 of the paper P than the coils springs B1*a* and B1*b* which bias the slider 120 in the insertion direction D2. Specifically, in a plan view in the thickness direction D3, the coil springs B2*a* and B2*b* are respectively disposed at positions which do not overlap the coils springs B1*a* and B1*b* in a planar structure and are in the vicinity of both ends in the width direction D4 which become the opposite sides with respect to the center of the second sliding surface TP. In addition, the other ends of the coil springs B1*a* and B1*b*, one end of each of which is fixed to each of spring support portions 123*a* and 123*b* of the slider 120, are respectively supported on or fixed to spring support portions (in FIGS. 5A and 5B, only a spring support portion 130*b* on one side is shown) provided at the slider cassette 130 so as to face the spring support portions 123*a* and 123*b* of the slider 120.

Further, in the slider cassette 130, an opening portion 130*h* is provided at the central portion in a plan view in the thickness direction D3, and the projecting portion 121 of the slider 120 is located in the opening portion 130*h*. Then, an opening margin 135 in the insertion direction D2 of the opening portion 130*h* is formed so as to come into contact with a locking portion 122 which becomes a portion of the projecting portion 121 of the slider 120, in a case where the slider 120 has moved in the insertion direction D2. Therefore, the slider cassette 130 is made so as to regulate the movement in the insertion direction D2 of the slider 120 by the opening margin 135 of the opening portion 130*h*.

On the other hand, at the slider cassette 130, a contact portion 131 is formed, and the end portion on the insertion direction D2 side of the cassette 20 which is inserted into the printer 11 moves as shown by a thick arrow in FIG. 2, thereby being comes into contact with the contact portion 131. In addition, in this embodiment, in the slider cassette 130, the other ends of the coil springs B2*a* and B2*b* and the coil springs B1*a* and B1*b* are supported on or fixed to a surface on the opposite side to the surface with which the cassette 20 comes into contact, at approximately the same position as the contact portion 131.

Incidentally, as shown in FIG. 2, the stopper 140 is provided with a first regulation surface 141 and a second regulation surface 142 which are approximately flat surfaces at the extraction direction D1 side facing the paper P. In this manner, the first regulation surface 141 and the second regulation surface 142 are formed at the same member. Further, in a state before the cassette 20 is mounted, the first regulation surface 141 is provided in a direction intersecting the guide surface 21*a* of the guide plate 21 and slightly inclined from the thickness direction D3 perpendicular to the insertion direction D2 to the guide surface 21*a* side. The second regulation surface 142 is provided so as to be perpendicular to the first regulation surface 141.

Further, the stopper 140 has a rotary shaft portion 146 formed at an end portion (in this case, a lower end portion) on the thickness direction D3 side and is mounted so as to be able to turn with respect to the base 110 with the rotary shaft portion 146 as a fulcrum. Therefore, the first and second regulation surfaces 141 and 142 provided at the stopper 140 also turn with the rotary shaft portion 146 as a fulcrum in accordance with the rotation of the stopper 140.

Further, at the stopper 140, a pair of wall portions extending parallel from both side ends in the width direction D4 toward the opposite side to the first regulation surface 141 is formed, and the cylindrical engagement pin 145, the axial direction of which extends in the width direction D4, is supported between the pair of wall portions. The engagement pin 145 is made so as to be engaged with the engagement space 125 provided at the projecting portion 121 of the slider 120 described above, thereby constituting a so-called cam mechanism. Due to the cam mechanism, the stopper 140 rotates around the rotary shaft portion 146 on the base end side along with the movement in the insertion direction D2 of the slider 120, so that the leading end side thereof is inclined to the insertion direction D2 side. Due to the inclination, the stopper 140 operates such that the entirety falls from a position (this is called a "regulation position") where the stopper 140 regulates the movement of the paper P before the cassette 20 is mounted, to the insertion direction D2 side, as shown by a two-dot chain line in the drawing, thereby retreating to a position (this is called a "retreat position") further on the insertion direction D2 side than the guide surface 21*a*. This operation will be described using FIGS. 4A and 4B and FIGS. 5A and 5B.

Figure 4A:
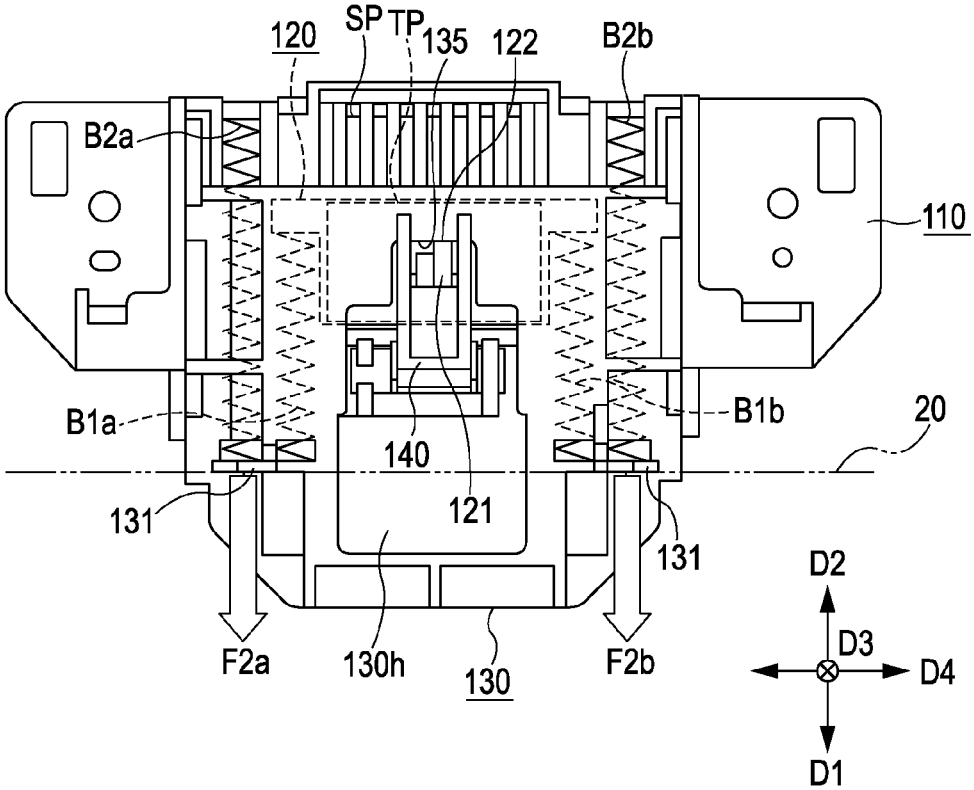
FIGS. 4A and 4B respectively are a plan view of the damper device in which a stopper is at a regulation position before cassette mounting and a plan view of the damper device immediately after cassette mounting.

As shown in FIG. 4A, in a non-mounting state before the cassette 20 comes into contact with the contact portion 131 of the slider cassette 130, the slider cassette 130 is biased in the extraction direction D1 by spring forces F2*a* and F2*b* of the coil springs B2*a* and B2*b*. Therefore, the opening margin 135 of the opening portion 130*h* pushes the locking portion 122 of the projection portion 121 of the slider 120 to the extraction direction D1 side, whereby the slider cassette 130 makes the slider 120 unable to be moved in the insertion direction D2. Further, at this time, the slider 120 is determined in position by contact with a stop portion (not shown) provided at the base 110 such that the slider 120 does not also move to the extraction direction D1 side. In this way, the slider 120 is positioned by the opening margin 135 of the slider cassette 130 and the stop portion of the base 110, thereby holding the stopper 140 at the regulation position (a position shown by a solid line in FIG. 2) where the stopper 140 regulates the movement of the paper P. In addition, at this regulation position, the slider 120 is made such that the second sliding surface TP thereof is located at the extraction direction D1 side in the plane area of the first sliding surface SP.

Figure 4B:
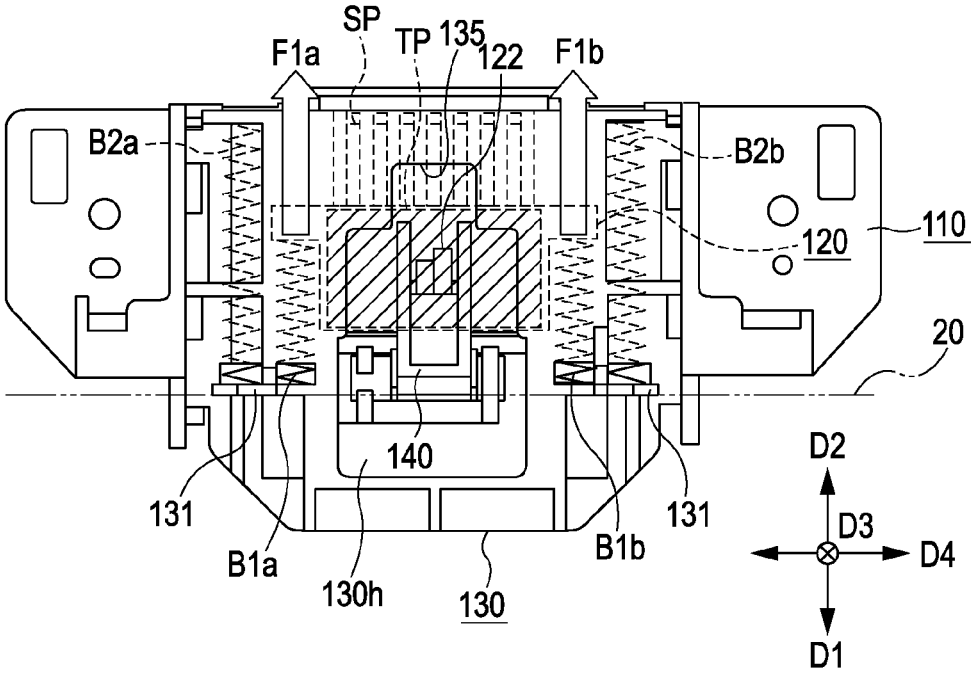

Next, as shown in FIG. 4B, if the cassette 20 is inserted, the slider cassette 130 is pushed and moved in the insertion direction D2 by the mounting of the cassette 20 which has come into contact with the contact portion 131. Therefore, since a state is created where the opening margin 135 of the slider cassette 130 has been separated from the slider 120 (the locking portion 122), the slider 120 enters into a state where it can move in the insertion direction D2. At this time, as described above, due to the action of the damper mechanism which is formed between the first sliding surface SP and the second sliding surface TP which faces the first sliding surface SP with viscous grease interposed therebetween, the slider 120 does not move immediately and the coil springs B1*a* and B1*b* temporarily enter into the compressed states.

The compressed coil springs B1*a* and B1*b* generate spring forces F1*a* and F1*b* in a direction following the insertion direction D2, as shown by white arrows in the drawing. Therefore, due to the generated spring forces F1*a* and F1*b*, the slider 120 moves (slides) on the first sliding surface SP along the insertion direction D2 while making the second sliding surface TP (the hatching portion in the drawing) thereof face the first sliding surface SP. In this movement, the damper force of the damper mechanism acts, whereby the slider 120 slowly moves in the insertion direction D2 at a speed according to the difference between the spring forces F1*a* and F1*b* and the damper force. For this reason, in the damper device 100, the stopper 140 which operates being linked with the slider 120 by the cam mechanism is made so as to slowly rotate from the regulation position to the retreat position by the action of the damper force which the damper mechanism exhibits.

Next, the rotational motion from the regulation position to the retreat position of the stopper 140 after mounting of the cassette 20 will be described with reference to FIGS. 5A and 5B. In addition, in FIGS. 5A and 5B, in order to facilitate explanation, some constituent members are shown in cross section as appropriate.

Figure 5A:
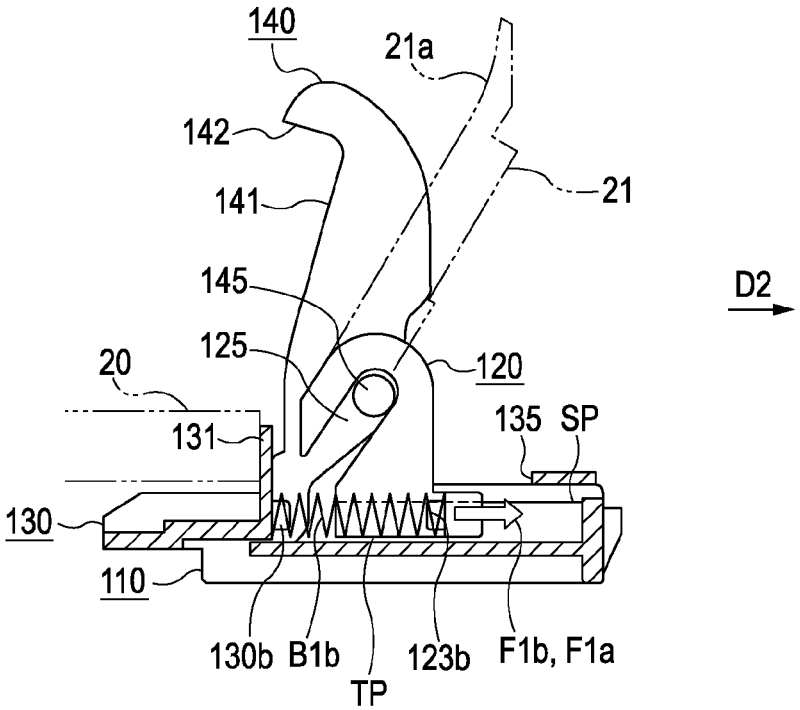
FIGS. 5A and 5B are respectively are a side view of the damper device in which the stopper is at the regulation position after cassette mounting and a side view of the damper device in which the stopper is at a retreat position.

First, as shown in FIG. 5A, immediately after the mounting of the cassette 20, the slider 120 is located for a moment at the regulation position without immediately moving in the insertion direction D2 due to the damper force of the damper mechanism. Thereafter, the slider 120 slowly moves to the insertion direction D2 side by the spring forces F1*a* and F1*b* of the coil springs B1*a* and B1*b* and the damper force of the damper mechanism which acts so as to resist the spring forces. At this time, due to the action of the cam mechanism by the engagement space 125 of the slider 120 and the engagement pin 145, the leading end portion of the stopper 140 slowly falls to the insertion direction D2 side.

Figure 5B:
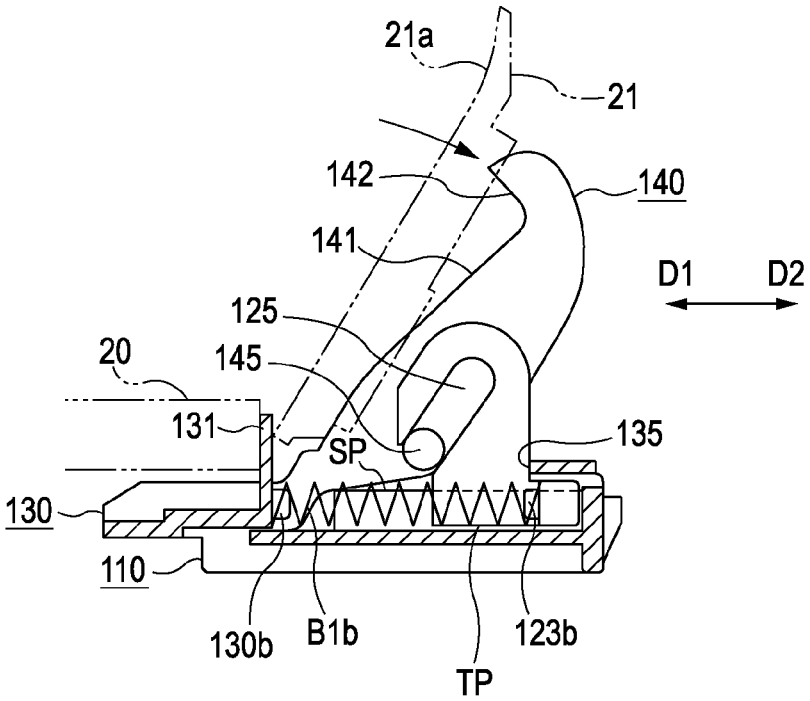

Then, as shown in FIG. 5B, in a state where the slider 120 has moved by a predetermined distance in the insertion direction D2, the end portion thereof on the insertion direction D2 side is positioned by contact with the stop portion (not shown) provided at the base 110. In a state where the slider 120 has been positioned, the stopper 140 rotates as shown by an arrow in FIG. 5B, thereby being located at the retreat position where it has retreated from the guide surface 21*a* of the guide plate 21 to the insertion direction D2 side. That is, at the retreat position, a state is created where the first regulation surface 141 and the second regulation surface 142 have retreated from the guide surface 21*a* of the guide plate 21 to the insertion direction D2 side.

Of course, if the cassette 20 is extracted from the mounting section 13, the slider cassette 130 is pushed and moved to the extraction direction D1 side by the biasing forces of the coil springs B2*a* and B2*b* and also returns the slider 120 to the original position before the cassette 20 is mounted. Then, the stopper 140 is configured so as to be rotated by the cam mechanism in accordance with the return of the slider 120 to the original position, thereby returning from the fallen state to the original state, that is, from the retreat position to the regulation position.

The damper device 100 configured in this manner is made so as to bring the paper P which moves to the insertion direction D2 side in accordance with the insertion of the cassette 20 into contact with the stopper 140, thereby stopping the paper P, during movement (rotation) of the stopper 140 from the regulation position to the retreat position. By this contact, it is possible to stop the paper P with a high probability so as not to be laid on the guide plate 21. That is, the stopper 140 is made so as to take an inertial force Fd (refer to a thick white arrow in FIG. 2) which is generated when the moving paper P decelerates, thereby regulating the movement of the paper P. In this way, by weakening the movement speed of the paper P and finally causing the kinetic energy of the paper P to disappear, the paper P is stopped with a high probability.

Figure 6A:
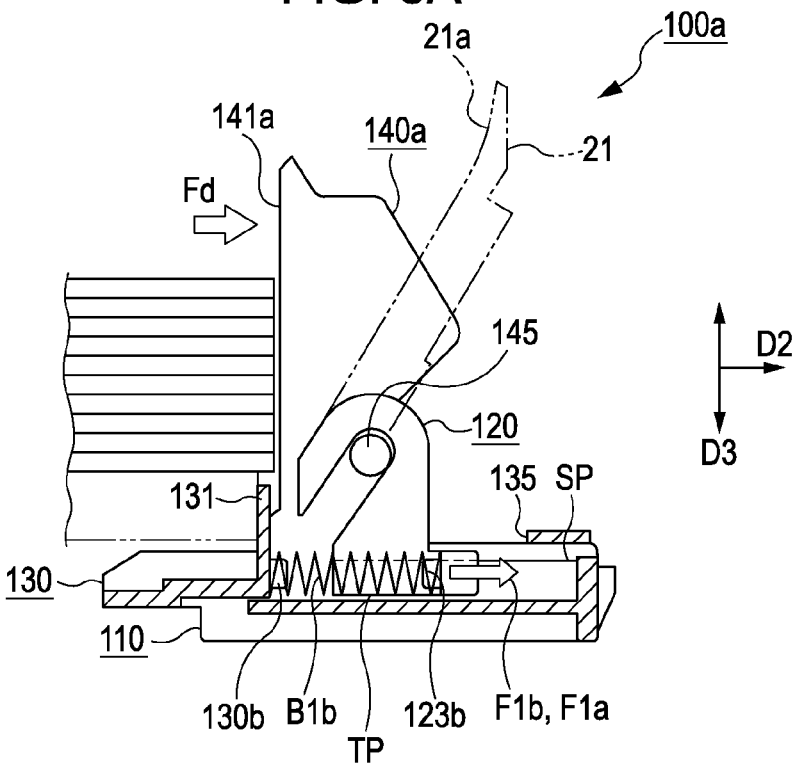
Figure 6B:
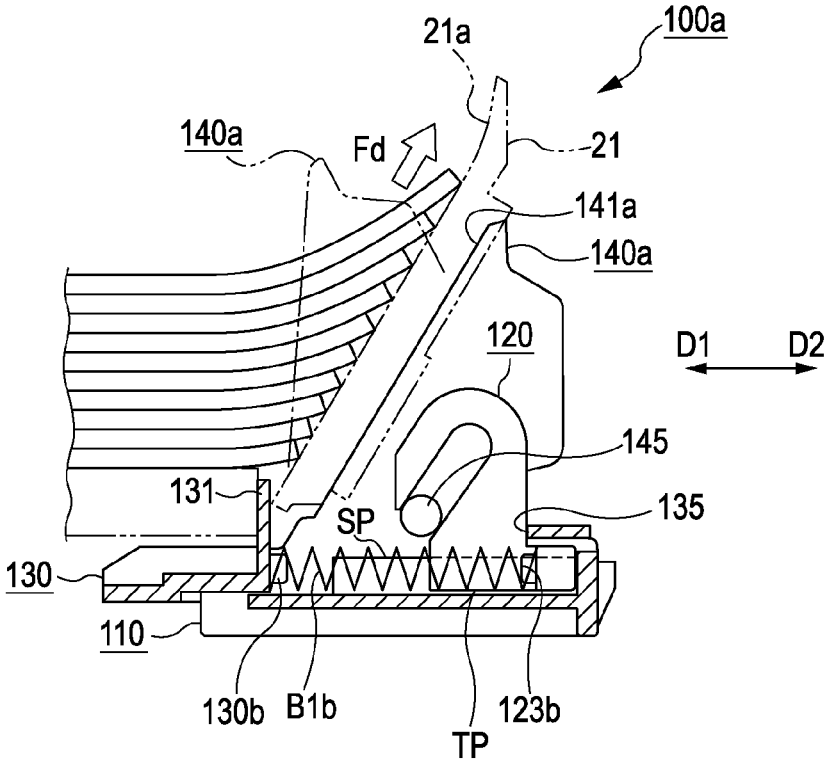

In order to facilitate the understanding of the stop operation of the paper P, a regulation state of movement of the paper P will be first described using a comparative example in which a stopper 140*a* having a different shape is provided in the damper device 100 of this embodiment, as shown in FIGS. 6A and 6B.

As shown in FIGS. 6A and 6B, in a damper device 100*a* of the comparative example, the stopper 140*a* is provided with only an approximately flat first regulation surface 141*a*. Then, in a state where the stopper 140*a* is located at the regulation position immediately after the cassette 20 is mounted, as shown in FIG. 6A, the first regulation surface 141*a* enters into a state where it is provided in an erect manner in a direction intersecting the guide surface 21*a* of the guide plate 21, that is, approximately in the thickness direction D3. On the other hand, by the movement of the stopper 140*a* from the erected state to a state where it has been inclined to the insertion direction D2 side, as shown in FIG. 6B, the first regulation surface 141*a* is located at the retreat position where it has retreated to the insertion direction D2 side with respect to the guide surface 21*a* of the guide plate 21.

Therefore, as shown in FIG. 6A, the stopper 140*a* brings a paper leading end portion Pse of the paper P which moves in the insertion direction D2 as a first direction in accordance with the movement in the insertion direction D2 of the cassette 20 at the time of mounting, into contact with the first regulation surface 141*a* perpendicular to the insertion direction D2. By this contact, the inertial force Fd of the paper P which is generated in the insertion direction D2 is taken. Then, by the stopper 140*a* which slowly moves to the retreat position due to the above-described damper mechanism, the kinetic energy of the paper P which has come into contact with the first regulation surface 141*a* is weakened and disappears, so that normally, the paper P stops during the movement to the retreat position.

However, for example, in a case where the number of stacked papers P placed on the cassette 20 is large, since kinetic energy which the paper P holds increases, the inertial force Fd which is generated also increases depending on the number of stacked papers. In such a case, the papers P push the stopper 140*a*, which should be originally slowly moved (rotated) to the retreat position due to the damper mechanism, in the insertion direction D2 by a large inertial force Fd while maintaining a contact state with the first regulation surface 141*a*, thereby moving the stopper 140*a* toward the retreat position. At this time, a matter arises where it is not possible to cause the kinetic energy which the paper P holds to disappear in a state where the stopper 140*a* does not take the large inertial force Fd which is generated and the papers P move (rotate) the stopper 140*a* and then come into contact with the guide surface 21*a*.

Then, as shown in FIG. 6B, since the papers P which have come into contact with the guide surface 21*a* continue to move further, the paper leading end portions Pse thereof move (rise) along a second direction intersecting the insertion direction D2 (the first direction), that is, along a direction of the guide surface 21*a* provided to extend. By this movement, the papers P are laid on the guide plate 21, whereby as described above, it is not possible to separate one by one the papers P by the guide surface 21*a* and a transport state called an overlap feed in which a plurality of papers P are overlapped and fed occurs.

Therefore, in this embodiment, by providing the second regulation surface 142 in addition to the first regulation surface 141, the inertial force Fd of the paper P which moves along the guide surface 21*a* is taken, thereby causing the kinetic energy to disappear, so that the paper P is stopped so as not to be laid on the guide plate 21. This action will be described with reference to FIGS. 7A to 7D.

Figure 7A:
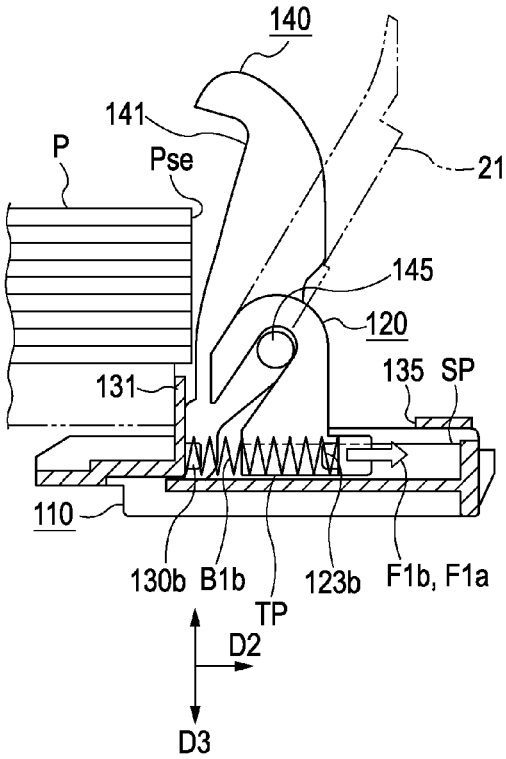

As shown in FIG. 7A, when the stopper 140 is located at the regulation position immediately after the cassette 20 is mounted, the first regulation surface 141 is provided in a direction slightly inclined from the thickness direction D3 perpendicular to the insertion direction D2 to the guide surface 21*a* side of the guide plate 21, as described above. Therefore, immediately after the mounting of the cassette 20, the paper leading end portion Pse of the stacked paper P on the lower side among the papers P in a stacked state which move in the insertion direction D2 by kinetic energy imparted thereto first comes into contact with the first regulation surface 141. On the other hand, on the contrary, in the paper P on the upper side, a clearance is present between the paper leading end portion Pse and the first regulation surface 141.

Figure 7B:
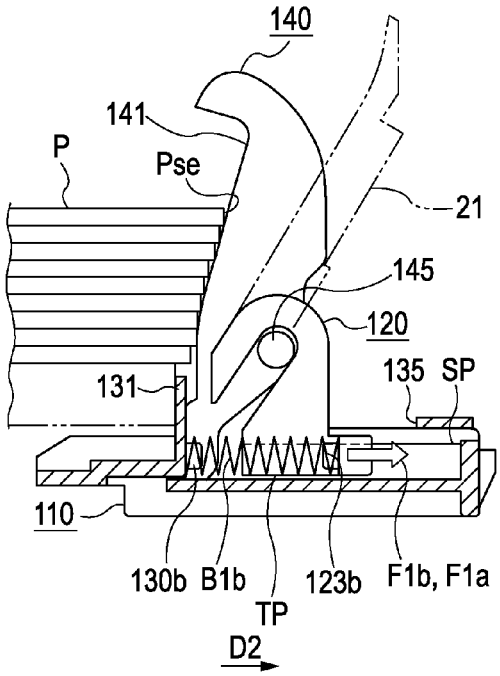

Therefore, as shown in FIG. 7B, each of the stacked papers P largely moves in the insertion direction D2 as it goes to the paper P on the upper side, thereby coming into contact with the first regulation surface 141 of the stopper 140 which starts to slowly move (rotate) due to the damper mechanism. As a result, the kinetic energy (the inertial force Fd) can be weakened by displacement in the insertion direction D2 which is mutually generated in the papers P.

Next, since the papers P in which the respective paper leading end portions Pse have come into contact with the first regulation surface 141 are regulated in movement by the stopper 140, thereby being decelerated, the papers P apply the inertial force Fd based on kinetic energy to the stopper 140. Due to this inertial force Fd, as shown in FIG. 7C, the papers P push the stopper 140 in the insertion direction D2 while maintaining the contact state with the first regulation surface 141, thereby rotating the stopper 140 up to a state where the paper leading end portions Pse come into contact with the guide surface 21*a*.

In this embodiment, the first regulation surface 141 is provided so as to be approximately flush with the guide surface 21*a* in a state where the paper leading end portion Pse of any of the papers P (for example, the paper leading end of the topmost paper P) has come into contact with the guide surface 21*a*. In other words, when the first regulation surface 141 has become approximately flush with the guide surface 21*a*, since a state is created where the second regulation surface 142 does not protrude from the guide surface 21*a*, a state is created where the movement in the insertion direction D2 of the paper P is not regulated. That is, in the stopper 140, the first regulation surface 141 enters into a state where it is located at a release position where it releases the regulation of movement in the insertion direction D2 of the paper P, since it has become approximately flush with the guide surface 21*a* and until the stopper 140 is located at the retreat position.

Figure 7C:
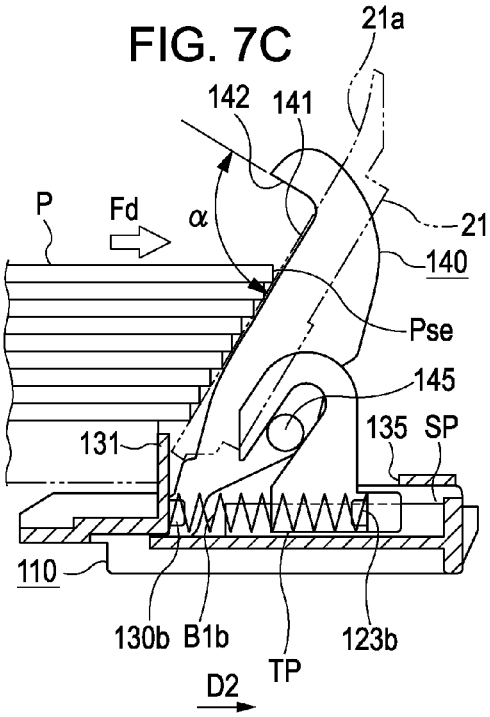

Further, in this state, the second regulation surface 142 provided at the stopper 140 is formed such that an angle $\alpha$ that it makes with the first regulation surface 141 becomes a right angle, as shown in FIG. 7C. Therefore, since the guide surface 21*a* and the first regulation surface 141 are approximately flush with each other, the second regulation surface 142 becomes a surface perpendicular to the guide surface 21*a*.

Figure 7D:
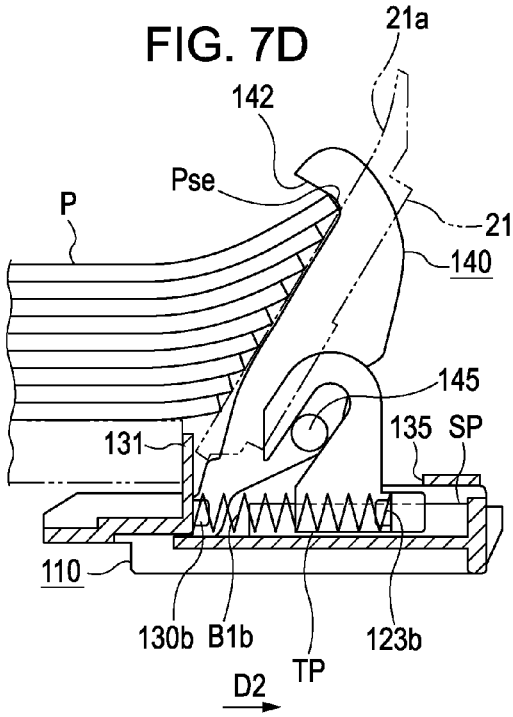

Incidentally, similarly to the above-described comparative example, in this manner, in a state where the paper leading end portions Pse have come into contact with the guide surfaces 21*a*, that is, a state where the first regulation surface 141 has been located at the release position, if kinetic energy remains in the paper P, the paper leading end portions Pse now try to move (rise) along the guide surface 21*a*. Then, in this embodiment, as shown in FIG. 7D, the paper leading end portion Pse which moves (rises) along the guide surface 21*a* comes into contact with the second regulation surface 142 provided at a member portion protruding from the guide surface 21*a* in the extraction direction D1 in the stopper 140. At this time, since the second regulation surface 142 is a surface which is at right angle to the guide surface 21*a*, the paper leading end portion Pse maintains a contact state without moving away from the guide surface 21*a*. As a result, the second regulation surface 142 is in a state where it is located at the regulation position where it regulates the movement of the papers P, and can stop the papers P by taking the inertial force Fd based on the remaining kinetic energy, thereby causing the kinetic energy to disappear reliably.

Then, after a state is created where the papers P have stopped, the stopper 140 automatically moves (rotates) to the retreat position shown in FIG. 5B by the damper mechanism. In the movement of the stopper 140 to the retreat position, after a state (not shown) is created where the second regulation surface 142 does not protrude from the guide surface 21*a* to the extraction direction D1 side, the second regulation surface 142 enters into a state where it does not regulate the movement of the papers P in a direction along the guide surface 21*a*. In other words, in the stopper 140, the second regulation surface 142 is in a state where it is located at the release position where it releases the regulation of movement of the papers P, during the period from the time a state has been created where it does not protrude from the guide surface 21*a* to the time it is located at the retreat position. As a result, the stopped paper P enters into a state where it can be fed to the recording section.

On the other hand, in this embodiment, for example, even in a case where kinetic energy is large even in a state where the number of stacked papers P is small, that is, a case where the cassette 20 is inserted at a fast speed at the time of mounting, so that the speed of the moving paper P is fast, it is possible to reliably regulate the movement of the papers, thereby stopping the papers. This will be described with reference to FIGS. 8A to 8C.

Figure 8A:
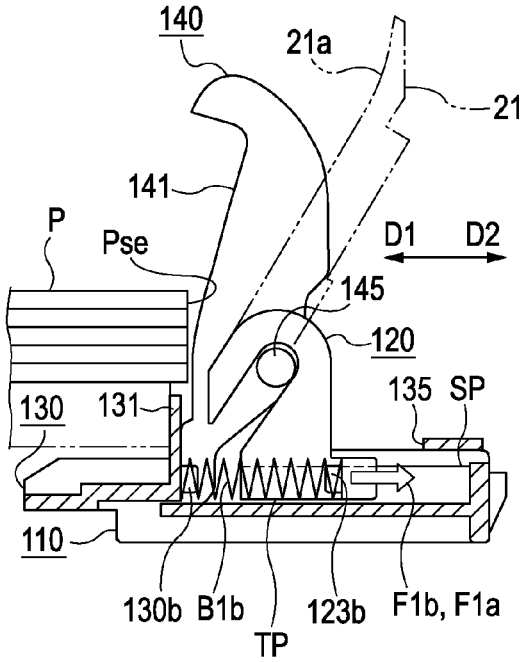

As shown in FIG. 8A, when the stopper 140 is located at the regulation position immediately after the cassette 20 is mounted, the papers P come into contact with the first regulation surface 141, similarly to FIG. 7A. That is, the paper leading end portion Pse of the paper P on the lower side among the stacked papers P comes into contact with the first regulation surface 141 and on the other hand, in the paper leading end portion Pse of the paper P on the upper side, a clearance is present between it and the first regulation surface 141.

Figure 8B:
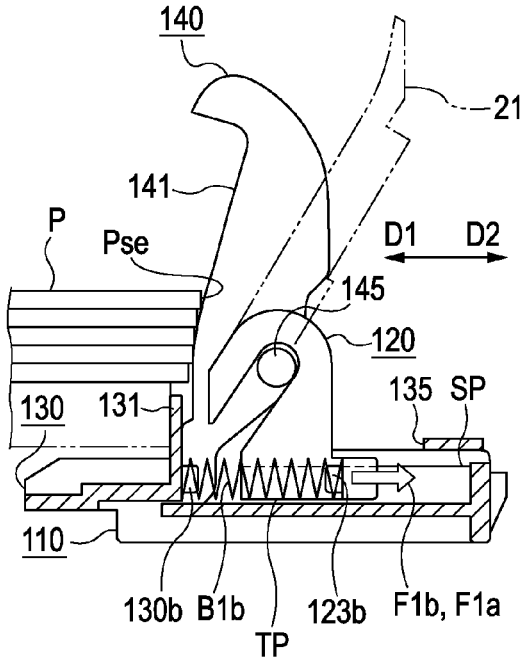

Then, as shown in FIG. 8B, the paper P largely moves in the insertion direction D2 as it goes to the paper P on the upper side, so that each paper P enters into a state where the paper leading end portion Pse thereof comes into contact with the first regulation surface 141 of the stopper 140, similarly to FIG. 7B. At this time, in FIG. 8B, since the movement speed of the paper P is fast, in the stopper 140 which tries to start to slowly move (rotate) due to the damper mechanism, the paper leading end portions Pse of the respective papers P come into contact with the first regulation surface 141 in a state where the smaller the movement (rotation) amount, the closer to the regulation position.

Then, since the movement speed of the paper P is fast, in a state where the paper leading end portions Pse of the papers P has come into contact with the first regulation surface 141, kinetic energy remains, so that the probability of continuing movement becomes high. As a result, the paper leading end portions Pse of the papers P move (rise) along the first regulation surface 141 exhibiting an inclined plane inclined with respect to the insertion direction D2, as shown in FIG. 8C.

Figure 8C:
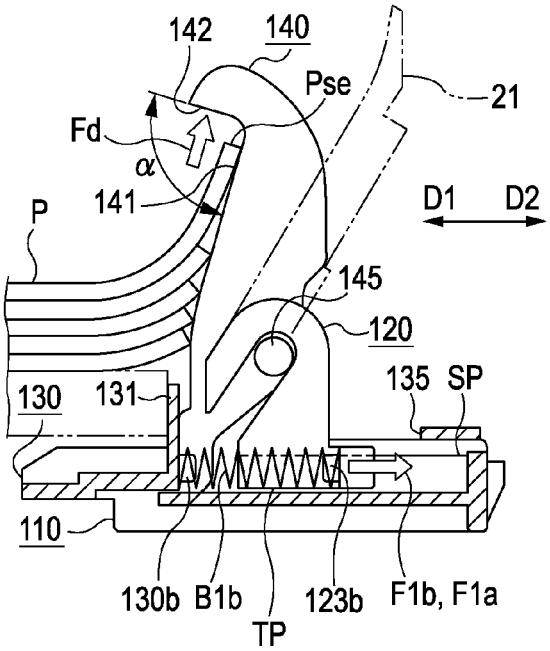

In this embodiment, as shown in FIG. 8C, the paper leading end portion Pse which moves (rises) along the first regulation surface 141 comes into contact with the second regulation surface 142 provided perpendicular to the first regulation surface 141 in the stopper 140. Therefore, since the paper leading end portion Pse keeps the contact state with the second regulation surface without moving away from the first regulation surface 141, the second regulation surface takes the inertial force Fd based on the remaining kinetic energy, thereby causing the kinetic energy to disappear reliably, so that it is possible to stop the paper P.

Then, after the paper P is stopped, the stopper 140 automatically moves (rotates) to the retreat position shown in FIG. 5B by the damper mechanism, whereby the first regulation surface 141 and the second regulation surface 142 are located at the release position where they do not protrude from the guide surface 21*a* to the extraction direction D1 side. As a result, the stopped paper P enters into a state where it can be fed to the recording section.

In addition, as shown in FIG. 2 and the like, the guide surface 21*a* formed at the guide plate 21 has a flat surface provided to extend in a direction intersecting the insertion direction D2 and a surface in which an inclined plane slightly inclined to the extraction direction D1 side is continuously formed at the downstream side (the upper side of the plane of paper) in the feed direction of the paper P with respect to the flat surface. Then, in this embodiment, at least the first regulation surface 141 is made so as to move from the regulation position to the release position in the flat surface of the guide surface 21*a*.

According to the embodiment described above, the following effects can be obtained.

(1) The papers P which move in the insertion direction D2 of the cassette 20 are regulated by the first regulation surface 141 provided at the stopper 140. Then, the paper P which is not regulated in movement at the point of time when the first regulation surface 141 has moved to the release position and moves along the guide surface 21*a* provided to be extended in a direction intersecting the insertion direction D2 is regulated by the second regulation surface 142 which is at the regulation position, whereby it is possible to stop the paper P with a high probability. Thereafter, since the second regulation surface 142 continues to move up to the release position, the paper P in which movement is stopped can be fed to the recording section side along the guide surface 21*a* by, for example, a transport section.

(2) since the first regulation surface 141 and the second regulation surface 142 move (rotate) completely in synchronization with each other, it is possible to move the stopper 140 such that when the first regulation surface 141 has moved from the regulation position up to the release position, the second regulation surface 142 is reliably located at the regulation position. As a result, since it is possible to stably stop the paper P which moves along the guide surface 21*a*, running-on of the paper P onto the guide surface 21*a* can be suppressed. Further, it is possible to move the first regulation surface 141 and the second regulation surface 142 by a single movement section (the slider 120).

(3) Since the paper P which moves along the guide surface 21*a* is made so as not to get away from the guide surface 21*a* by the second regulation 142, thereby maintaining the contact state with the second regulation surface 142, it is possible to reliably stop the movement of the paper P. As a result, running-on of the paper P onto the guide surface 21*a* can be suppressed.

(4) The paper P which moves along the first regulation surface 141 before the paper P comes into contact with the guide surface 21*a* can be reliably stopped by the second regulation surface 142. Therefore, running-on of a target onto the guide surface 21*a* can be suppressed.

In addition, each embodiment described above may also be changed to other embodiments as described below.

In each embodiment described above, as the movement regulation body, a structural form in which both the first regulation surface 141 and the second regulation surface 142 are provided at a single stopper 140, that is, a form in which the first regulation surface 141 and the second regulation surface 142 are formed at the same member has been illustrated. However, a form in which they are formed at separate members is also acceptable. For example, the movement regulation body may also made in the form of a two-body structure having a first regulation member provided with the first regulation surface 141 and a second regulation member being a separate body from the first regulation member and provided with the second regulation surface 142. This modified example will be described with reference to FIGS. 9A to 9C.

Figure 9A:
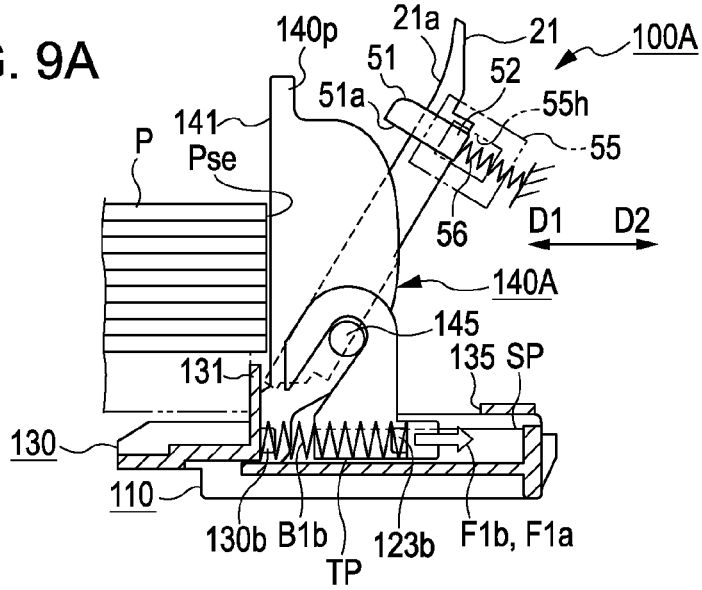

As shown in FIG. 9A, a damper device 100A of this modified example includes, as movement regulation bodies, a first stopper 140A as the first regulation member provided with the first regulation surface 141 and a second stopper 51 as the second regulation member provided with a regulation surface 51*a* equivalent to the second regulation surface 142. At the first stopper 140A, an engagement portion 140*p* having a shape protruding in a predetermined width at the rotating tip side is formed. At the second stopper 51, a projecting portion 52 protruding in the width direction (a direction perpendicular to the plane of paper) of the paper P is formed, and the projecting portion 52 is made so as to slide in an opening hole 55*h* provided in a support plate 55 fixed to a case. Further, the second stopper 51 is made such that the projecting portion 52 is biased in the extraction direction D1 by a spring 56, whereby a portion protrudes further to the extraction direction D1 side than the guide surface 21*a*.

Figure 9B:
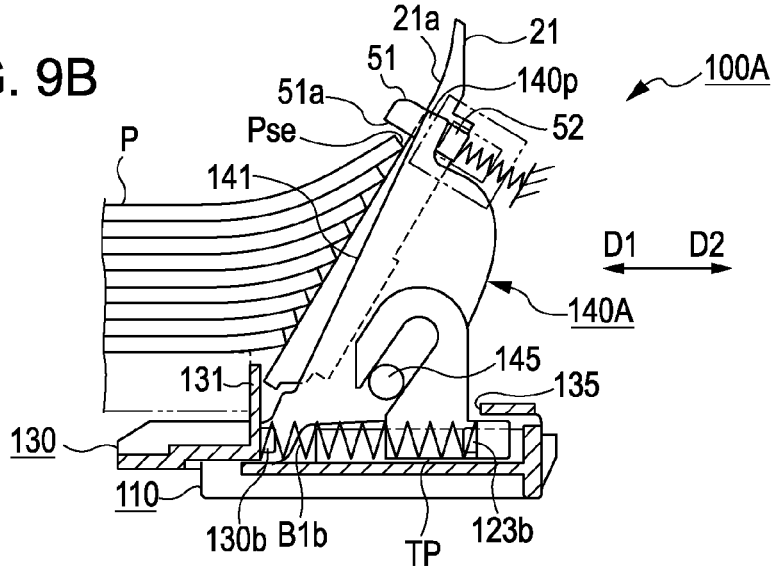
Figure 9C:
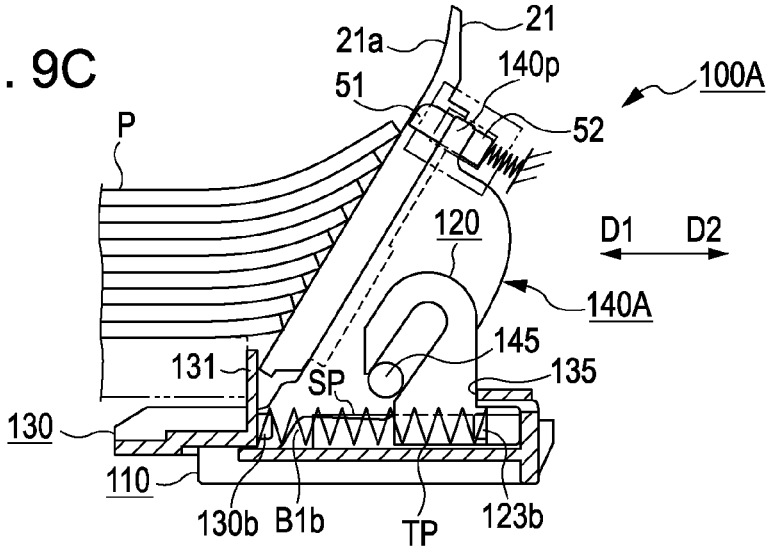

By the first stopper 140A and the second stopper 51 configured by two bodies in this manner, it is possible to stop the paper P with a high probability, similarly to the above-described embodiment. That is, first, as shown in FIG. 9A, the paper leading end portions Pse of the papers P which move in the insertion direction D2 at the time of mounting of the cassette 20 first come into contact with the first regulation surface 141 of the first stopper 140A. Then, the paper leading end portions Pse push and tilt the first stopper 140A in the insertion direction D2 due to the inertial force Fd based on kinetic energy, and after the first regulation surface 141 reaches the guide surface 21*a*, the paper leading end portions Pse of the papers P move (rise) along the guide surface 21*a*, as shown in FIG. 9B.

The risen paper P comes into contact with the regulation surface 51*a* provided at a portion protruding from the guide surface 21*a* to the extraction direction D1 side. Here, the regulation surface 51*a* is formed as a surface perpendicular to the guide surface 21*a*. Therefore, the paper P which moves along the guide surface 21*a* maintains the contact state without moving away from the guide surface 21*a*, whereby the movement thereof is regulated. Therefore, it is possible to stop the paper P with a high probability. In addition, in the regulation surface 51*a*, the amount of projection thereof from the guide surface 21*a* to the extraction direction D1 side is set so as to be able to regulate the movement of the paper P.

Then, after the paper P is stopped, in the first stopper 140A which continues to move (rotate) to the retreat position, the engagement portion 140*p* is engaged with the projecting portion 52 of the second stopper 51, thereby sliding the projecting portion 52 in the opening hole 55*h* in the insertion direction D2 against the biasing force of the spring 56. In this way, since the second stopper 51 is located at the release position where the regulation surface 51*a* has been retreated from the guide surface 21*a* to the insertion direction D2 side, the paper P enters into a state where the papers P can be fed one by one by the guide surface 21*a* after stopping.

In addition, although explanation has been omitted in the embodiment described above, in the stopper 140 in which the first regulation surface 141 and the second regulation surface 142 are formed at the same member, at a joint of the first regulation surface 141 and the second regulation surface 142, a cylindrical surface caused by the manufacturing of the stopper 140 is sometimes formed continuously to the flat surface. Therefore, the paper P which moves along the guide surface 21*a* moves in a direction in which the paper is separated from the guide surface 21*a* due to the cylindrical surface. For this reason, in a case where it is difficult for the paper P to stably maintain the contact state with the second regulation surface 142, a case where the movement regulation effect of the paper P cannot be sufficiently obtained can also arise. In contrast to this, in this modified example, since the first regulation surface 141 and the regulation surface 51*a* that is the second regulation surface 142 are constituted by separate members, a joint having such a cylindrical surface is not present structurally. Therefore, it is possible to reliably obtain the movement regulation effect of the paper P.

Figure 10A:
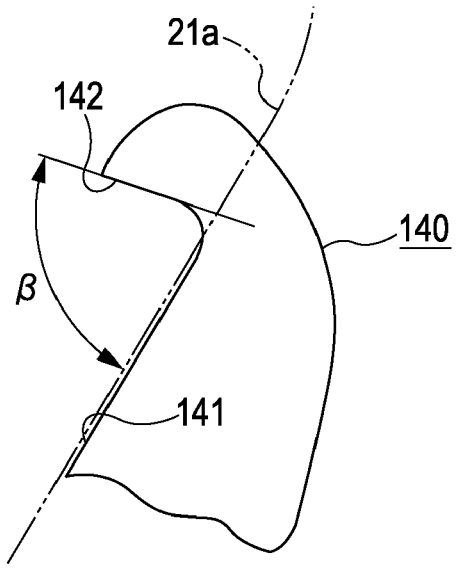
FIGS. 10A and 10B are outline diagrams showing the shapes of the regulation surface of the stopper of the modified example.

In each embodiment described above, the first and second regulation surfaces 141 and 142 provided at the stopper 140 have been made so as to form a right angle with each other. However, it is not necessarily limited thereto. For example, the first regulation surface 141 and the second regulation surface 142 may also be made so as to form a non-obtuse angle. That is, as shown in FIG. 10A, in the stopper 140, the flat surface of the first regulation surface 141 and the flat surface of the second regulation surface 142 are provided such that an angle β which they form becomes an angle smaller than 90 degrees. In this way, in a state where the first regulation surface 141 has become flush with the guide surface 21*a*, the second regulation surface 142 forms an acute angle between it and the guide surface 21*a*. As a result, since the paper leading end portion Pse of the paper P which has come into contact with the second regulation surface 142 can be reliably moved to the guide surface 21*a* side by the second regulation surface 142, it is possible to reliably regulate the movement of the paper P.

Figure 10B:
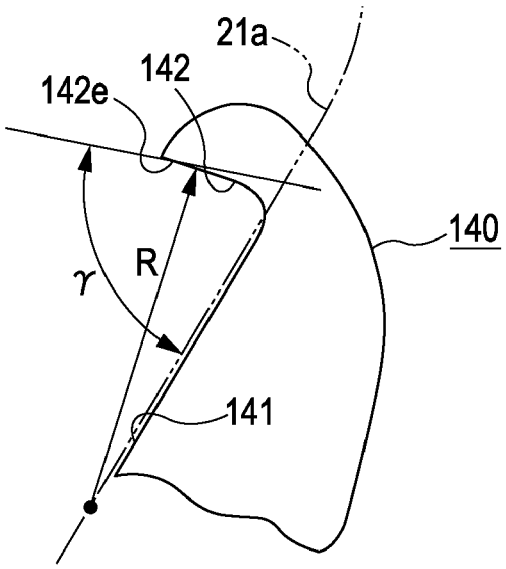

Further, the second regulation surface 142 may not be necessarily formed as a flat surface. For example, an arc shape is also acceptable. As one example, as shown in FIG. 10B, in the stopper 140, the second regulation surface 142 may also be provided as an arc surface (a cylindrical surface) which has the center on an extended surface (extended line) of the flat surface of the first regulation surface 141 and is determined by a given radius R. That is, an angle γ that a flat surface contacting with the second regulation surface 142 makes with the first regulation surface 141 is set such that the closer to a tip portion 142*e* on the extraction direction D1 side in the second regulation surface 142, the smaller the angle becomes than 90 degrees. In this way, in a state where the first regulation surface 141 has become flush with the guide surface 21*a*, the second regulation surface 142 forms an acute angle between it and the guide surface 21*a* as it moves away from the guide surface 21*a*. As a result, since the paper leading end portion Pse of the paper P which has come into contact with the second regulation surface 142 can be reliably moved to the guide surface 21*a* side by the second regulation surface 142 without being separated from the guide surface 21*a*, it is possible to reliably regulate the movement of the paper P.

In each embodiment described above, the recording apparatus is embodied in the ink jet type printer 11. However, a recording apparatus which ejects or discharges liquid other than ink may also be adopted. It is possible to divert the invention to various recording apparatuses which are each provided with a recording head or the like that discharges a minutely small quantity of liquid droplets. Note, "liquid droplet" means a liquid in a state of being discharged from the above recording apparatus and also includes droplets of a granular shape or a tear shape, or droplets tailing into a line. Further, it is acceptable if the liquid as mentioned herein is a material that a recording apparatus can eject. For example, it is acceptable if the liquid is a substance in a state when it is in a liquid phase, and the liquid includes not only liquids in a liquid state with high or low viscosity and in a flow state such as sol, gel water, other inorganic or organic solvents, a solution, a liquid resin, or a liquid metal (molten metal), and liquid as one state of substance, but also a material in which particles of a functional material composed of a solid material such as pigment or metal particles are dissolved, dispersed, or mixed in a solvent, or the like. Further, ink as described in the above-described embodiments can be given as representative examples of the liquid. Here, ink is set to include general water-based ink, oil-based ink and various liquid compositions such as gel ink or hot-melt ink. As a specific example of the recording apparatus, there is a recording apparatus that ejects liquid that includes, in a dispersed or dissolved form, a material such as an electrode material or a color material, which is used for the manufacture or the like of, for example, a liquid crystal display, an EL (electroluminescence) display, a surface-emitting display, or a color filter. Furthermore, a cloth printing apparatus, a micro-dispenser, or the like is also acceptable. Thus, the invention can be applied to any type of recording apparatus among these apparatuses.

The entire disclosure of Japanese Patent Application No. 2010-212445, filed Sep. 22, 2010 is expressly incorporated by reference herein.

What is claimed is:

1. A transport device comprising:

a guide member having an inclined guide surface which guides a target;

a stopper which comes into contact with the target ahead of the guide surface of the guide member and regulates movement of the target;

a slider which slides by contact of the target with the stopper;

a first regulation surface which is provided at the stopper and with which the target comes into contact ahead of the guide surface of the guide member;

a second regulation surface which is provided at the stopper and regulates the movement of the target which moves along the first regulation surface; and a damper mechanism which is connected to the slider, has a damper force that weakens kinetic energy by the target that the stopper received, and makes the first regulation surface and the second regulation surface of the stopper retreat further than the guide surface of the guide member, thereby releasing regulation of the target by the first regulation surface and the second regulation surface and allowing the target to come into contact with the guide surface of the guide member.

2. The transport device according to claim 1, wherein after the first regulation surface retreats further than the guide surface of the guide member, thereby releasing regulation of the target, the second regulation surface retreats further than the guide surface of the guide member, thereby releasing regulation of the target.

3. The transport device according to claim 2, wherein the second regulation surface is a surface which makes a non-obtuse angle with the guide surface when the first regulation surface has moved to a position where the first regulation surface releases regulation of the target.

4. The transport device according to claim 1, wherein in a state where the first regulation surface and the second regulation surface make a non-obtuse angle at all times, the first regulation surface and the second regulation surface retreat further than the guide surface of the guide member, thereby releasing regulation of the target.

5. A recording apparatus comprising:

the transport device according to claim 1; and a recording section which performs recording on a target which is transported by the transport device.

* * * * *